US007225923B2

(12) United States Patent
Hallee et al.

(10) Patent No.: US 7,225,923 B2
(45) Date of Patent: Jun. 5, 2007

(54) MULTI-CONFIGURED TOOL BIT BOX

(75) Inventors: Kristofor M. Hallee, San Francisco, CA (US); Ian W. Cunningham, Matthews, NC (US); Jonathan S. Holz, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 412 days.

(21) Appl. No.: 10/722,906

(22) Filed: Nov. 25, 2003

(65) Prior Publication Data

US 2004/0144671 A1 Jul. 29, 2004

Related U.S. Application Data

(60) Provisional application No. 60/449,998, filed on Feb. 25, 2003, provisional application No. 60/442,472, filed on Jan. 24, 2003, provisional application No. 60/434,455, filed on Dec. 17, 2002.

(51) Int. Cl.
*B65D 85/00* (2006.01)

(52) U.S. Cl. ..... 206/373; 206/379

(58) Field of Classification Search ..... 206/349, 206/372, 373, 379; 211/69, 70.6
See application file for complete search history.

(56) References Cited

U.S. PATENT DOCUMENTS 4,153,178 A * 5/1979 Weavers ..... 220/315
D277,339 S 1/1985 Huot, Jr. et al.
4,512,467 A 4/1985 Knoblauch
4,615,464 A * 10/1986 Byrns ..... 220/4.23
4,660,719 A 4/1987 Peterson et al.
4,934,530 A 6/1990 Riess
4,955,478 A 9/1990 Rau et al.
4,958,732 A 9/1990 Rau et al.
5,098,235 A 3/1992 Svetlik et al.
5,148,914 A 9/1992 Budert et al.
5,429,235 A * 7/1995 Chen ..... 206/373
5,628,400 A 5/1997 Feder
5,669,492 A 9/1997 Chao
5,746,316 A 5/1998 La Barre
D394,806 S 6/1998 Budert
D394,952 S * 6/1998 Wei ..... D3/273
5,775,499 A 7/1998 Budert
5,813,533 A 9/1998 Knoblauch
5,829,596 A * 11/1998 Budert ..... 206/379
5,967,318 A * 10/1999 Rosler ..... 206/372
6,024,218 A 2/2000 Knoblauch
6,032,796 A * 3/2000 Hopper et al. ..... 206/377
6,283,291 B1 9/2001 Vasudeva et al.
6,547,077 B1 4/2003 Budert
D481,868 S * 11/2003 Cunningham et al. ..... D3/273
6,755,302 B1 * 6/2004 Streich et al. ..... 206/373
2004/0144671 A1 7/2004 Hallee et al.

* cited by examiner

*Primary Examiner*—David Fidei
(74) *Attorney, Agent, or Firm*—Dennis J. Williamson; Moore & Van Allen PLLC

(57) ABSTRACT

A tool case for the storage of drill bits and similarly shaped tools includes two housing members that are hingedly attached and which open and close, with respect to one another. The tool case of the present invention includes elastomeric material surrounding the periphery of the tool case and tool trays on the inside of the case that retain inverted drill bits and similarly shaped tools. The tool trays disposed within the two housing members are removably attached to inner recessed cavities in the housing member by snapping male protrusions located on the tray into corresponding female recesses located on the inner surface of the recessed cavities.

22 Claims, 15 Drawing Sheets

MULTI-CONFIGURED TOOL BIT BOX

RELATED APPLICATIONS

This application claims priority from three provisional applications, STORAGE CONTAINER FOR ELONGATED TOOLS, filed Dec. 17, 2002, Ser. No. 60/434,455, TOOL CASE INSERT HAVING PUSHBUTTON-RELEASE TOOL RETENTION, filed Feb. 25, 2003, Ser. No. 60/449,998, and TOOL CASE HAVING ELASTOMERIC SURROUND AND INVERTED BIT HOLDING CONFIGUATION, filed Jan. 24, 2003, Ser. No. 60/442,472, the entirety of which are incorporated herein by reference.

FIELD OF THE INVENTION

This invention relates to storage containers for elongated tools, such as drill bits. In particular, the invention relates to a tool retaining system with a tool tray that ensures that the tools will remain in their original position when shaken or inverted.

BACKGROUND OF THE INVENTION

Tool parts, such as drill bits, are sold in sets consisting of many parts of varying sizes. When using, storing, or transporting such tool parts, it is desirable to keep them organized and ready for use. One manner of organizing tool parts is to secure them in individual compartments. It is also desirable that if the tool parts are stored within an outer toolbox or casing, that they do not move about within such outer member. A typical lid or cover may not keep the tools in place within a casing, leaving the inner organizational system to shift to various positions within the case.

While an inner organizational system may be permanently adhered to an outer member, this limits the craftsman to the type of tool that may be stored within the outer member. Providing an interchangeable inner member, a manufacturer may choose to substitute a tool tray that houses drill bits with one that houses wrenches or screwdrivers, for example.

In addition to improved organization, it is also desirable that the tool parts are easily accessible to the user. When a tool part is secured within a storage container, it may be difficult for the user to quickly and easily remove the tool from its secured position.

In addition to keeping the tools secured and organized, it is important that the outer member of the tool case be easily gripped and handled. Past attempts at configuring a tool case out of plastic have not produced easily graspable cases due to the texture of the material used to construct the case. Also, when a tool casing is closed, the user is often not able to identify what is located within the case unless the case is opened.

In order to retain a tool case in the closed position, various sliding latches have been provided. In past configurations, however, the user will not be able to easily leverage the latch into the open position. This can be very frustrating for a craftsman who wears gloves or otherwise requires a more convenient latching configuration.

Once open, it is desirable that the case be accessible to the user. Generally, tool cases and other tool boxes lie flat in an open position. Such a position may make it difficult for the contents to easily be viewed by the user. In addition to being able to see what is enclosed within the case while working, the user must also be able to easily grasp and remove the bit without having to touch and potentially dull the sharp end of the bit. However, by simply turning the bit upside down in the case, the user is prevented from visualizing the exact tool that is needed before the tool is removed from its compartment. Accordingly, there is a need for a tool case that will remedy the above problems and make it easier for the user to utilize his or her tools. The present invention addresses these desirable features, as will become clear in the following description.

BRIEF SUMMARY OF THE INVENTION

The present invention includes a tool retaining system that provides the above-stated needs in the art and overcomes the above shortcomings. The present tool retaining system provides improved organization and is easily manipulated by the user.

In accordance with the present invention, a tool retaining system comprises an outer casing having at least one housing member with upstanding walls extending approximately perpendicularly from a base and a plurality of female recesses defined within said walls. The tool retaining system further comprises a tool tray having at least two opposed side walls extending approximately perpendicularly downward from a top wall, the opposed side walls having an outer surface, the outer surface having one or more male protrusions extending therefrom, and the top wall having a plurality of tool receiving recesses, each of the tool receiving recesses including at least two opposed bit retaining members. The male protrusions on the tool tray snap into the female recesses on the walls of the outer casing.

In another embodiment of the present invention, a tool retaining system comprises at least two housing members that are hingedly attached with respect to one another, at least one of the housing members defines a recessed cavity for receiving a tool tray. The recessed cavity is comprised of a base and at least two upstanding walls that include a plurality of female recesses. The tool retaining system further comprises a tray. The tool tray includes a plurality of male protrusions extending from at least two side walls of the tool tray, the tool tray being removably securable to the at least one housing member in non-slidable fashion by snapping the male protrusions into mating position with the female recesses.

In yet another embodiment of the present invention, a tool retaining box for storing drill bits and the like has elastomeric material disposed at least partially around an outer periphery of the box. This material provides the system with increased durability, shock absorbency, and improved gripping characteristics.

The present invention also includes a kit comprising an outer casing and at least one tool tray, as previously described. Other objects, features and advantages of the present invention will become more fully apparent from the following detailed description of the preferred embodiment and the accompanying drawings.

DETAILED DESCRIPTION OF THE INVENTION

The tool retaining system of the present invention includes an outer casing and a tool tray, for storing and transporting elongated tool parts, such as drill bits. For the purposes of illustration, the tool parts will be referred to as drill bits. It is understood by those of skill in the art that the storage container of the present invention could be adapted to fit and receive similar types of tools or tool parts, such as screwdrivers or socket bits.

Figure 1:
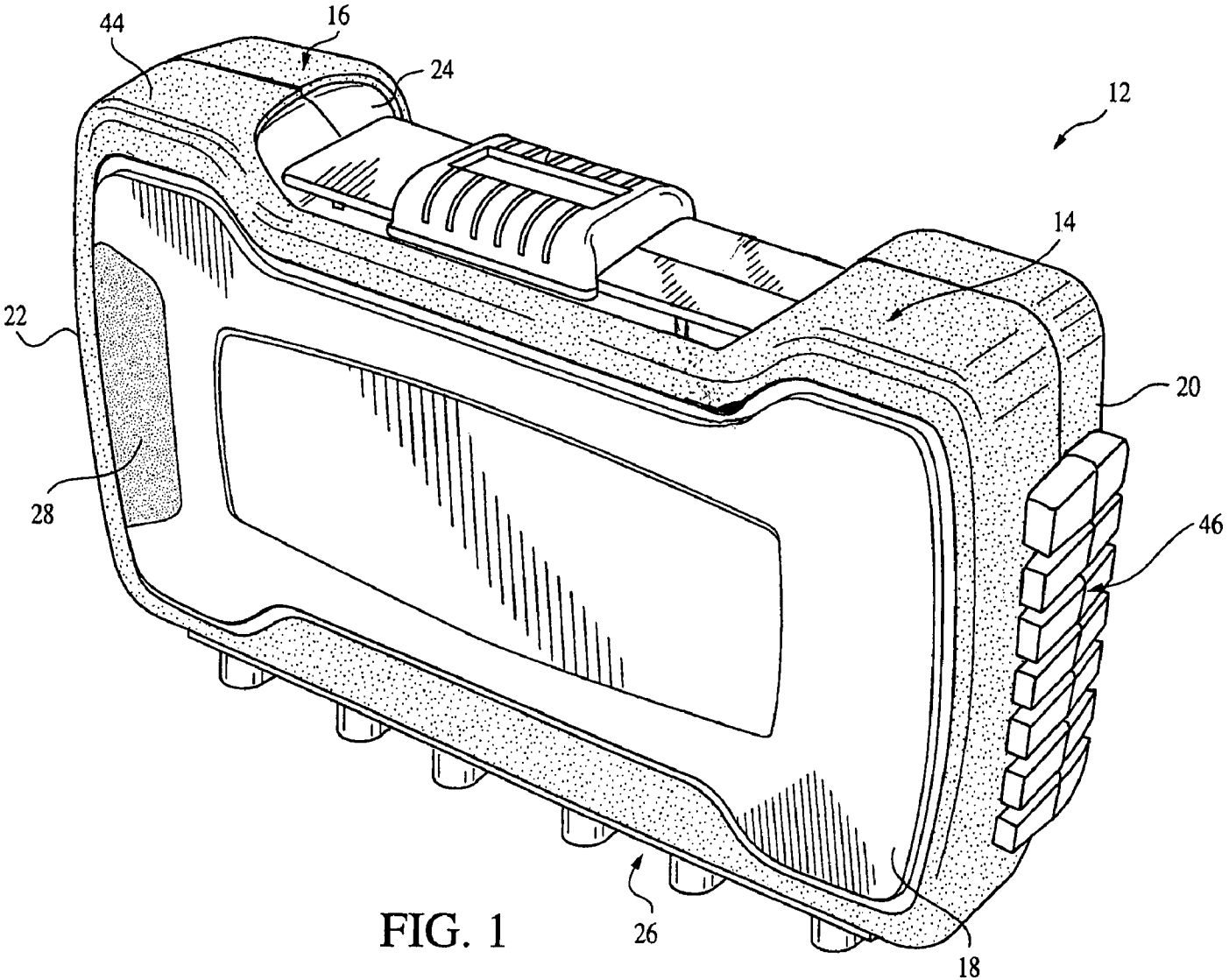
FIG. 1 is a perspective view of an embodiment of the tool retaining system of the present invention.

FIG. 1 shows the storage container, more specifically, the outer casing 12 of the present invention. The outer casing 12 includes at least one, but desirably two outer housing members; a frontal housing member 14 and a rear housing member 16. Each housing member 14 and 16 includes a base 18 with two short sides 20 and 22, a top wall 24, and a hinged wall 26, extending upwardly therefrom and defining at least a portion of a recessed cavity therein. Additionally, the housing members 14 and 16 may include a labeling area 28 that is lightly textured to allow labeling of the case with a printed logo, a permanent marker, or other writing instrument. This is useful so that a user may label the contents of the tool case and maintain an organizational system. The housing members 14 and 16 are manufactured by standard and well-known injection molding techniques, although other materials and methods may be used in this and other embodiments.

Figure 2:
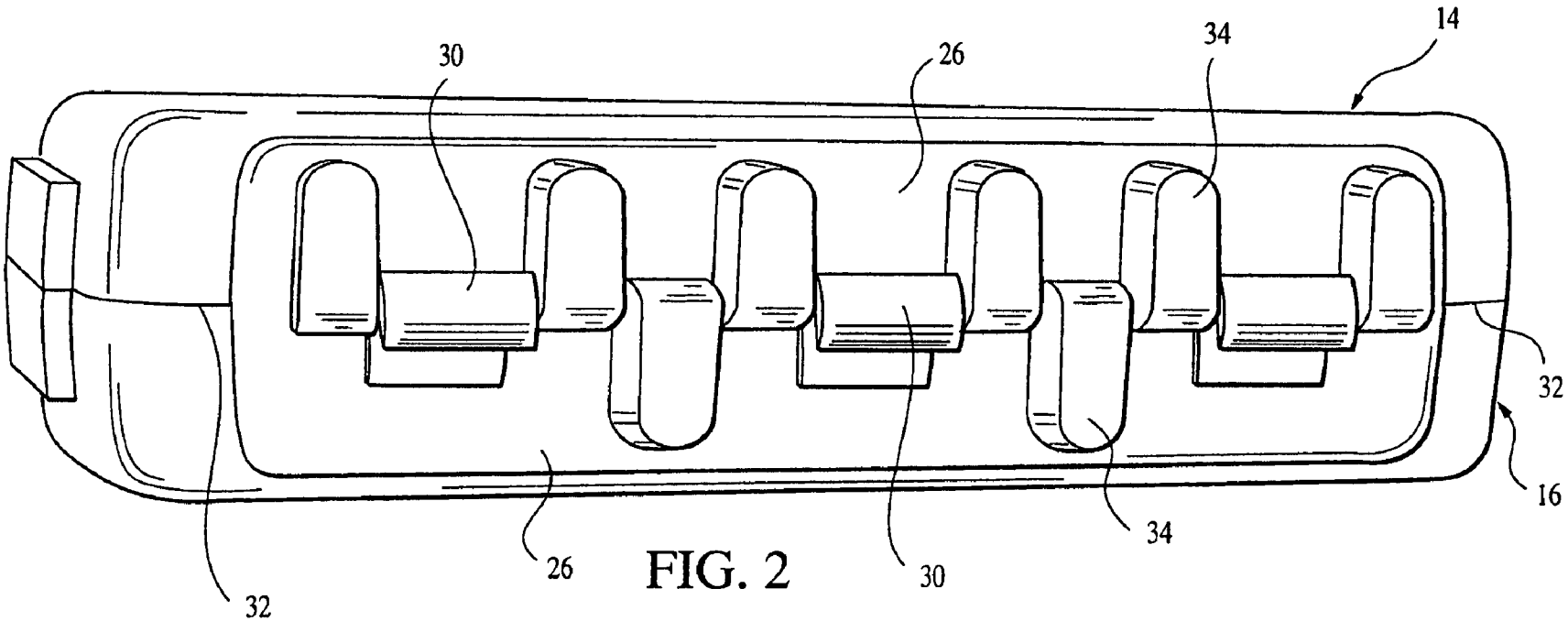
FIG. 2 is a bottom perspective view an embodiment of the tool retaining system of FIG. 1.

FIG. 2 shows the hinged walls 26 of the housing members 14 and 16 pivotally connected by a hinge 30 which is disposed along the matching hinged walls 26. The hinged walls 26 form the bottom seam 32 of the case. The hinge 30 allows the two housing members 14 and 16 to open and close with respect to one another. The hinge 30 may be constructed entirely from the same material as the housing members 14 and 16, wherein the plastic hinge members snap together to form the hinge 30. Optionally, a metal rod may be inserted through the hinge members to form the hinge (not shown).

Figure 3:
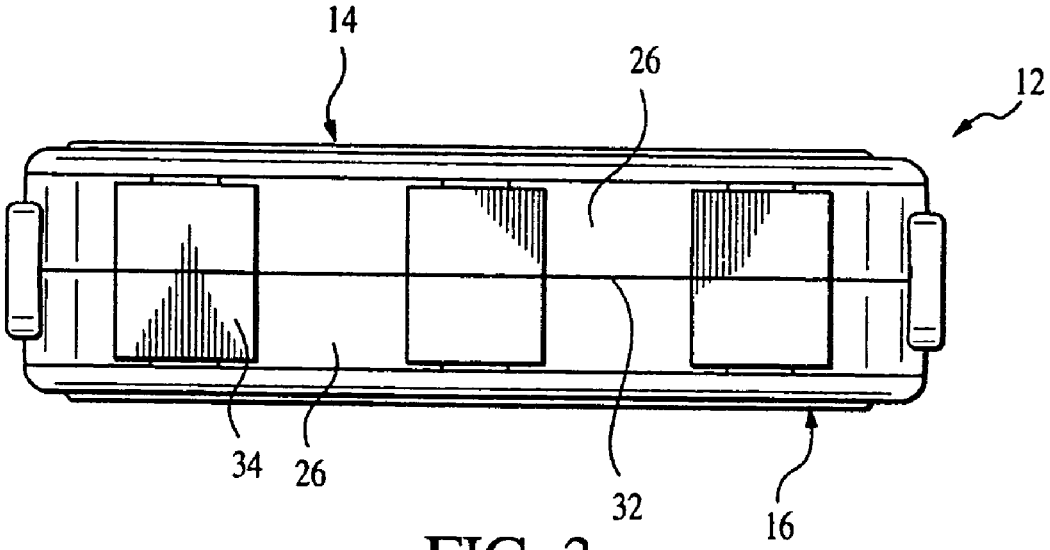
FIG. 3 is a bottom perspective view of another embodiment of the tool retaining system of the present invention.

The outer casing 12 includes block-feet 34 which are disposed along the outer surfaces of the hinged bottom walls 26, as shown in FIGS. 2 and 3. This allows the case 12 to stand upright over the hinged surface. Approximately half of each block foot 34 is disposed on each of the housing members 14 and 16 to allow the case 12 to open and close, respectively. The feet 34 can be cube-shaped or oval, and the respective halves of the feet can be staggered along the bottom seam 32 of the outer casing 12 (See FIG. 2).

Figure 4:
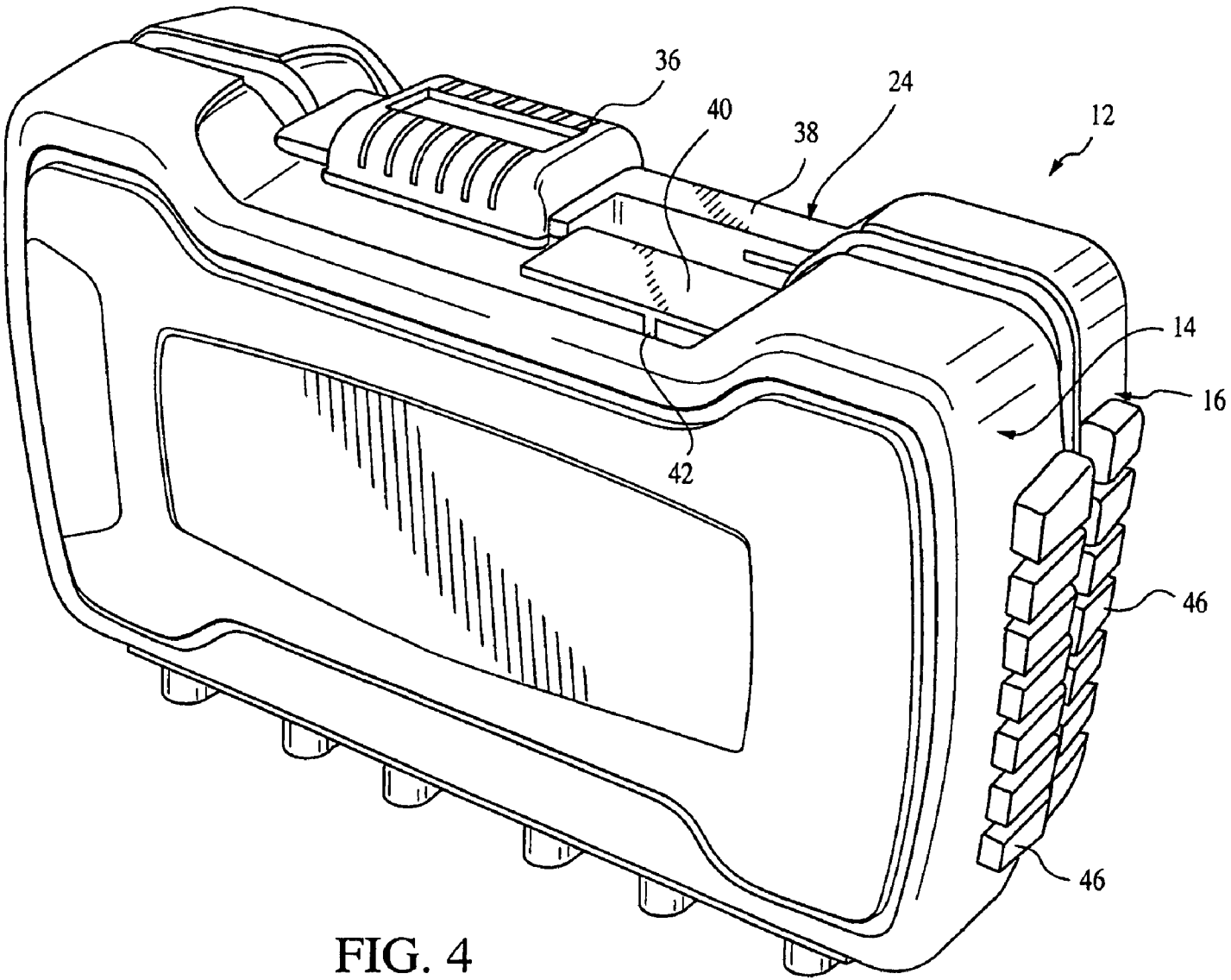
FIG. 4 is a perspective view of the tool retaining system of FIG. 1 in a slightly open configuration.

FIG. 4 shows a latching assembly which secures the outer casing 12 in a closed position. A sliding latch 36 is disposed at the top wall 24 of one of the housing members 14 or 16. The latch 36 slides back and forth along a split-rail to open and close the outer casing 12. The split-rail is defined by a first rail ledge 38 on the top wall 24 of the rear housing member 16 and a second rail ledge 40 on the top wall 24 of the frontal housing member 14. The second rail ledge has a length that is less than the length of the first rail ledge 38. The discrepancy in length is approximately equal to the length of the latch 36, itself, thereby allowing the latch 36 to release the frontal housing member 14 when positioned over portion of the first rail ledge 38 that is not adjacent the second rail ledge 40.

In addition, the latch 36 is restricted with regard to the length of the split-rail that it may move across. An abutment 42 is molded of plastic, or other suitable material, and disposed along the split-rail, preventing the latch 36 from completely sliding the entire length of the rail. This feature ensures that the user will be able to insert a finger or thumb behind the latch 36 to open the outer casing 12 easily.

Referring again to FIG. 1 (see also FIG. 4), the outer casing 12 of the present invention also includes a band of elastomeric material 44 surrounding the periphery of the outer casing 12. The elastomeric material 44 may be a soft rubber or other suitable material. The rubber, for example, is continuously attached to the top wall 24, short sides 20 and 22, and hinged wall 26 of the respective housing members 14 and 16 to allow the user to grip the closed case 12 easily. The elastomeric material 44 may be added to the outer casing 12 by injection molding after the creation of the outer casing 12 itself. Notches (not shown) may be added in the short side 20 and/or 22 of the mold to more securely attach the elastomeric material 44 during the molding process. The elastomeric band 44 also adds durability and shock resistant properties to the outer casing 12. Optionally, the material 44 may extend to cover the hinge (not shown).

Figure 5:
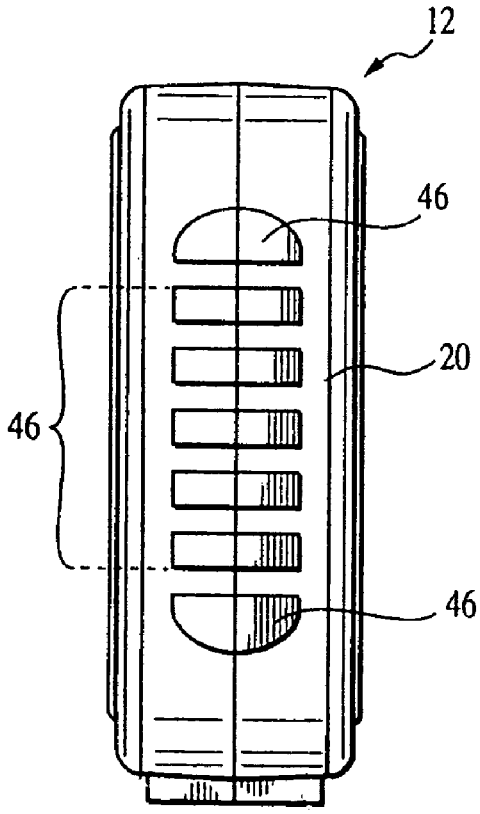
FIG. 5 is a side view of an embodiment of the tool retaining system of the present invention.

The band of elastomeric material 44 may define a flat tread pattern 46 on each of the short sides 20 and 22 of the case 12. (See also FIG. 5). The tread 46 is desirably, but not limited to, an oval shape and protrudes from the surface of the outer casing 12. The sections of the band 44 that define the tread 46 are desirably spaced apart with two rounded ends and at least one square middle section. The tread 46 defines a level surface so that the outer casing 12 may stand if the user wishes to stack the case on its short side 20 or 22. About half of the oval-shaped tread 46, lengthwise, protrudes from the frontal housing member 14 and the other half protrudes from the rear housing member 16. By separating the tread 46 in approximately half, the outer casing 12 will stand on the tread 46 even when the casing 12 is open.

Figure 6:
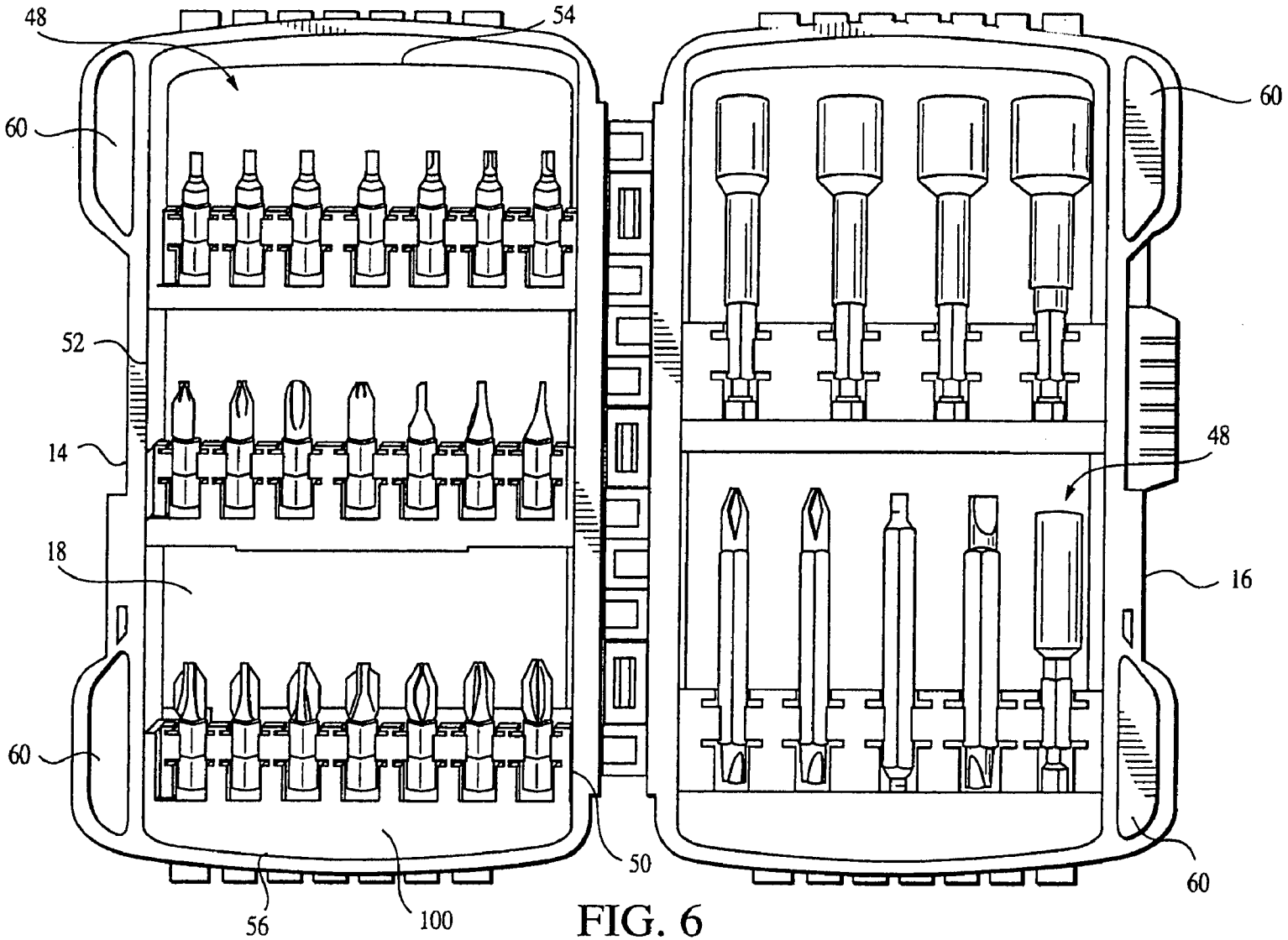
FIG. 6 is a top view of an embodiment of the tool retaining system of the present invention in an open configuration.
Figure 7:
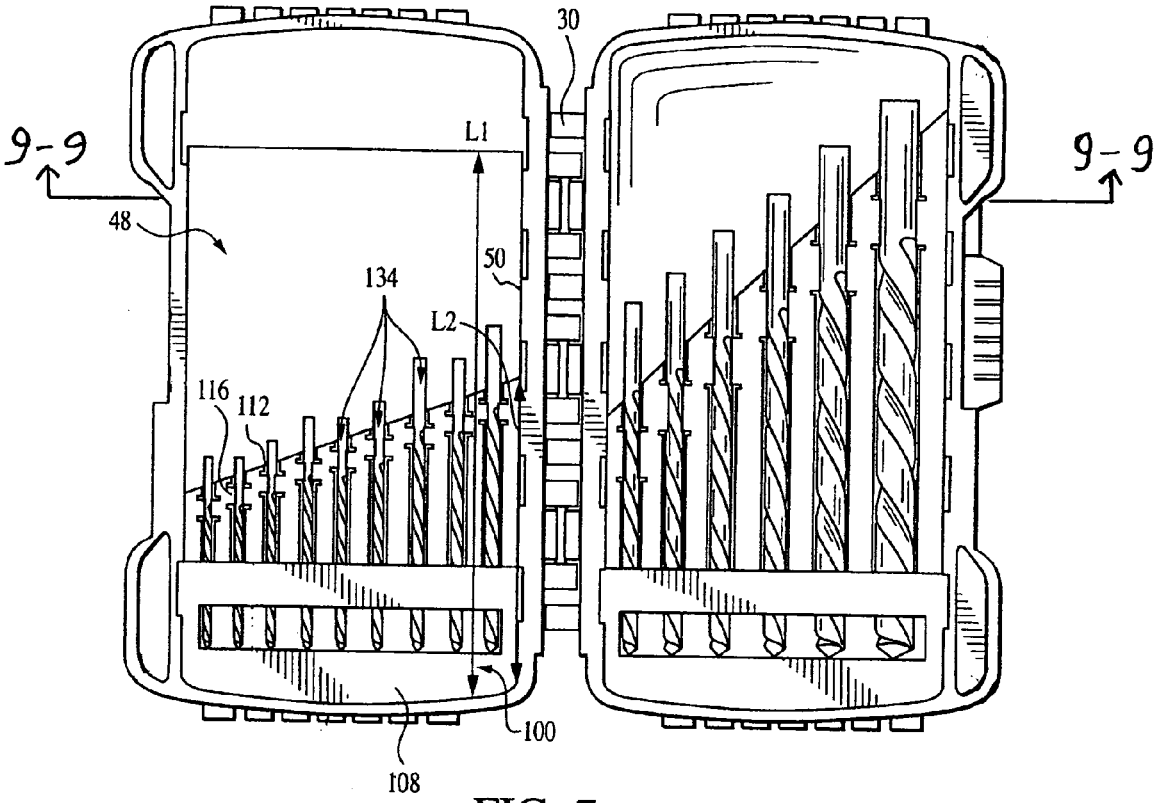
FIG. 7 is top view of another embodiment of the tool retaining system of the present invention in an open configuration.

FIGS. 6 and 7 illustrate possible embodiments of the present invention. Looking now to FIG. 6, the inside surfaces of the frontal 14 and rear housing members 16 are similar to one another. Each housing member 14 and 16 desirably houses at least one tool tray 100. The tool trays 100 are customized to fit various elongated tools and tool parts. The tool trays are removably secured within recessed cavities 48. The recessed cavities 48 are defined by two opposed side walls 50 and 52, a front wall 54, a rear wall 56, and the housing member base 18. Each cavity 48 is generally rectangular in shape, but may be constructed to be square or any other suitable shape.

Each of the housing members 14 or 16 may have at least two empty corners 60 that are created by the approximately ninety degree angle between a short side wall 50 or 52 and the front wall 54 or rear wall 56 of the recessed cavity 48. These corners 60 may remain empty, not filled in with molding, to accommodate additional storage space for the user.

FIGS. 6 and 7 show the outer casing and tool tray in interlocking position. As shown in FIG. 7, the tool tray 100 may cover the entire cavity 48 and extend along the entire length of the recessed cavity L1. More preferably, the tray 100 will have a length L2 that is less than the length L1 of the recessed cavity 48. The length of the top wall 108 is desirably proportional to the length of the drill bits 134 to be stored therein. It should be noted that other dimensional relationships may be used.

Figure 8:
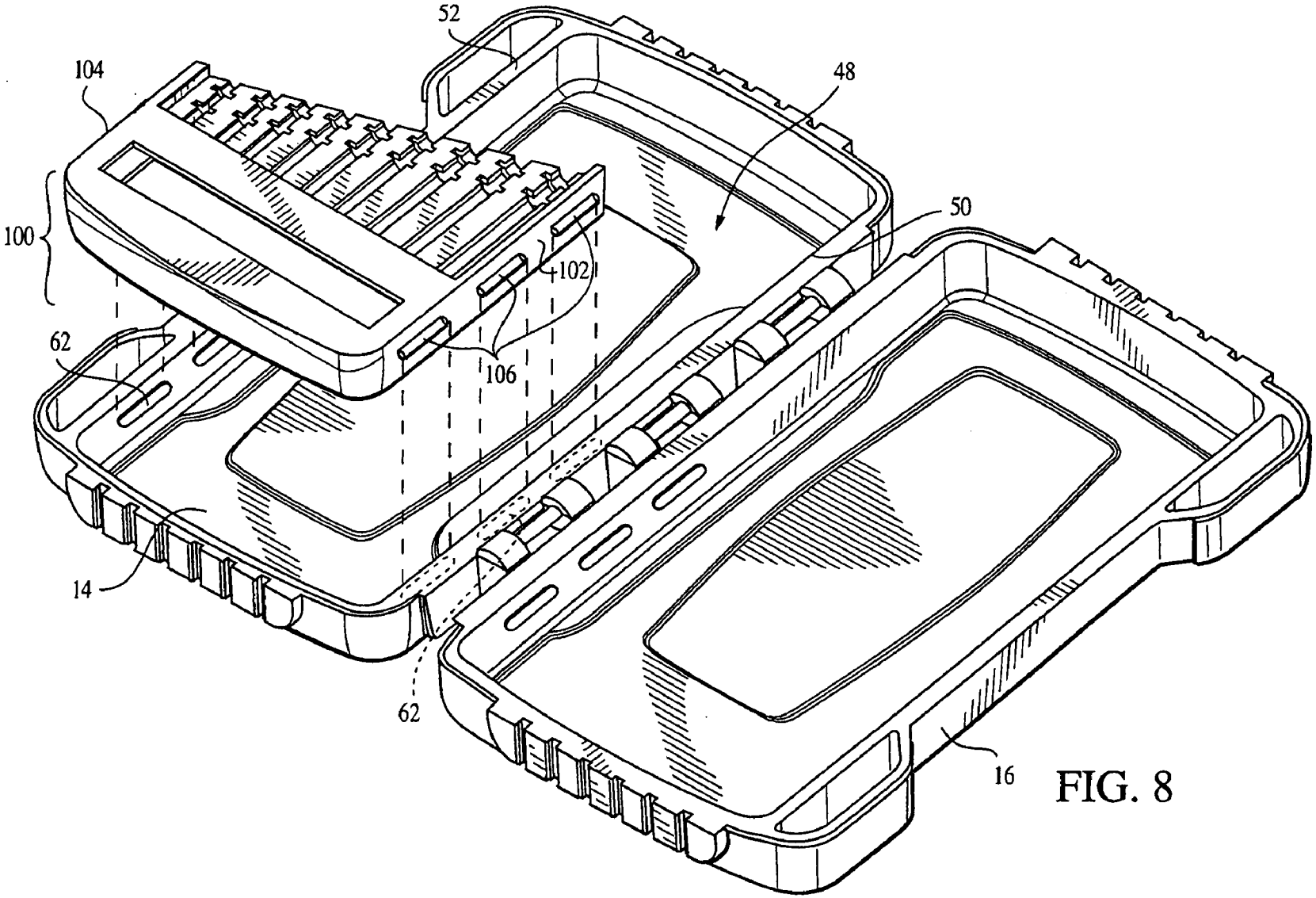
FIG. 8 is an exploded perspective view of an embodiment of the tool retaining system of the present invention in an open configuration.

FIG. 8 illustrates the recessed cavities 48 of the housing members 14 and 16 and the tool tray 100 in an exploded view. The opposed side walls 50 and 52 of the recessed cavities 48 include a plurality of concave female recesses 62. These female recesses 62 may be equally spaced apart and are molded into the interior surface of the opposing side walls 50 and 52.

The tool tray 100 of the present invention is removably secured to the inside surfaces of at least one of the recessed cavities 48 in a non-slidable fashion. The exterior periphery of the tool tray 100 is dimensioned to be adjacent to the inner periphery of the recessed cavity 48 along at least one of the opposed side walls of the tray 102 and 104. At least the opposed side walls 102 and 104 of the tool tray 100 include convex male protrusions 106. These male protrusions 106 are equally spaced apart and are molded to project outwardly from the exterior surface of the opposing side walls 102 and 104 of the tray 100.

Figure 9:
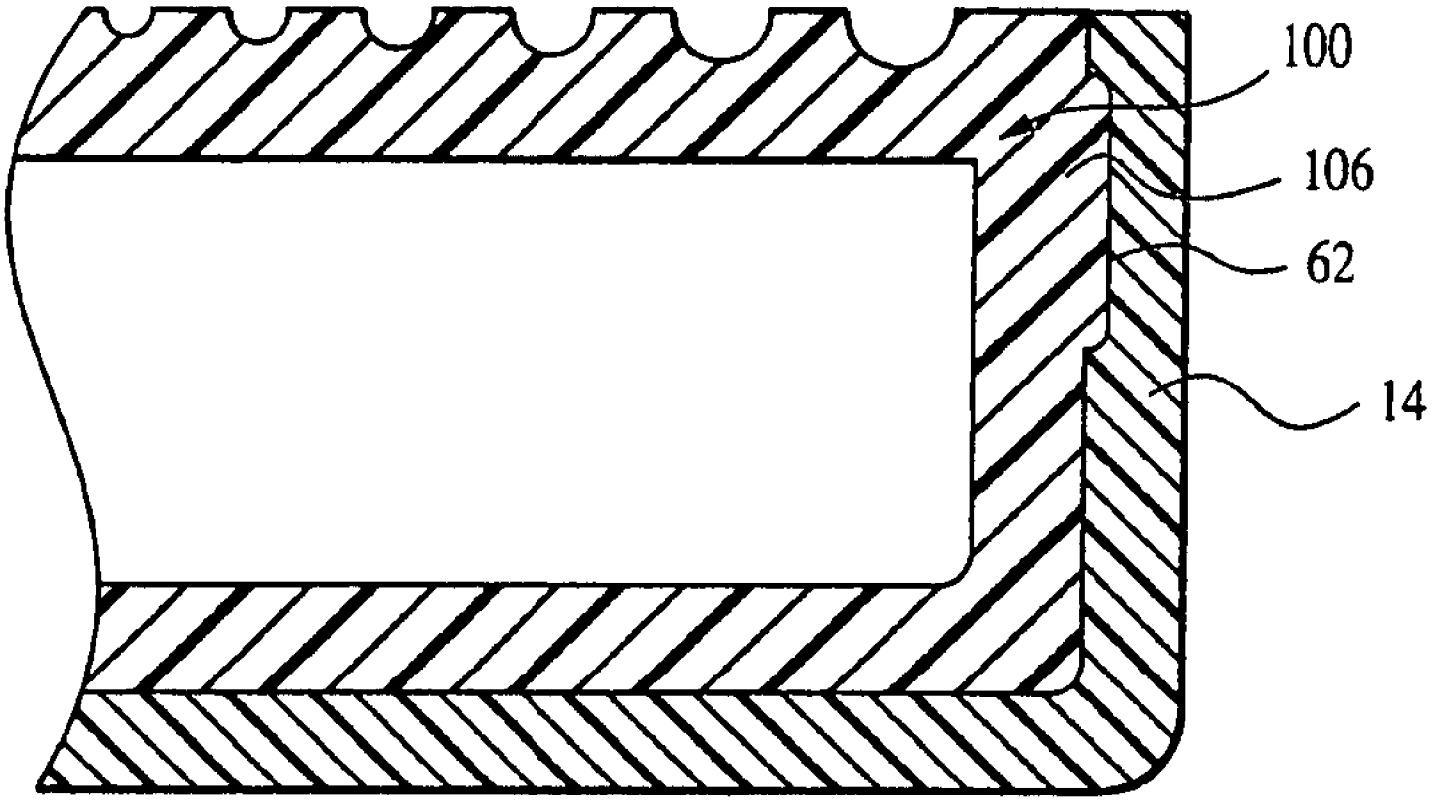
FIG. 9 is a cross sectional view of the tool retaining system of FIG. 7 along line 9—9.

The placement of the male protrusions 106 corresponds to the placement of the female recesses 62 located on the interior surface of the side walls 50 and 52 of the recessed cavity 48. The tool tray 100 is stored inside the recessed cavity 48 of the housing member 14 and/or 16 and is removably secured to the recessed cavity 48 by snapping the male protrusions 106 and female recesses together 62. (See FIG. 9). Desirably, the convex male protrusions and female recesses fit together in such a way to prevent the tool tray from sliding or moving from its intended storage position. The tray 100 may be made to be nonremovably attached, as well. The flexibility of the housing members and the tray allows the male protrusions and female recesses to snap into place without breaking either component.

Figure 10:
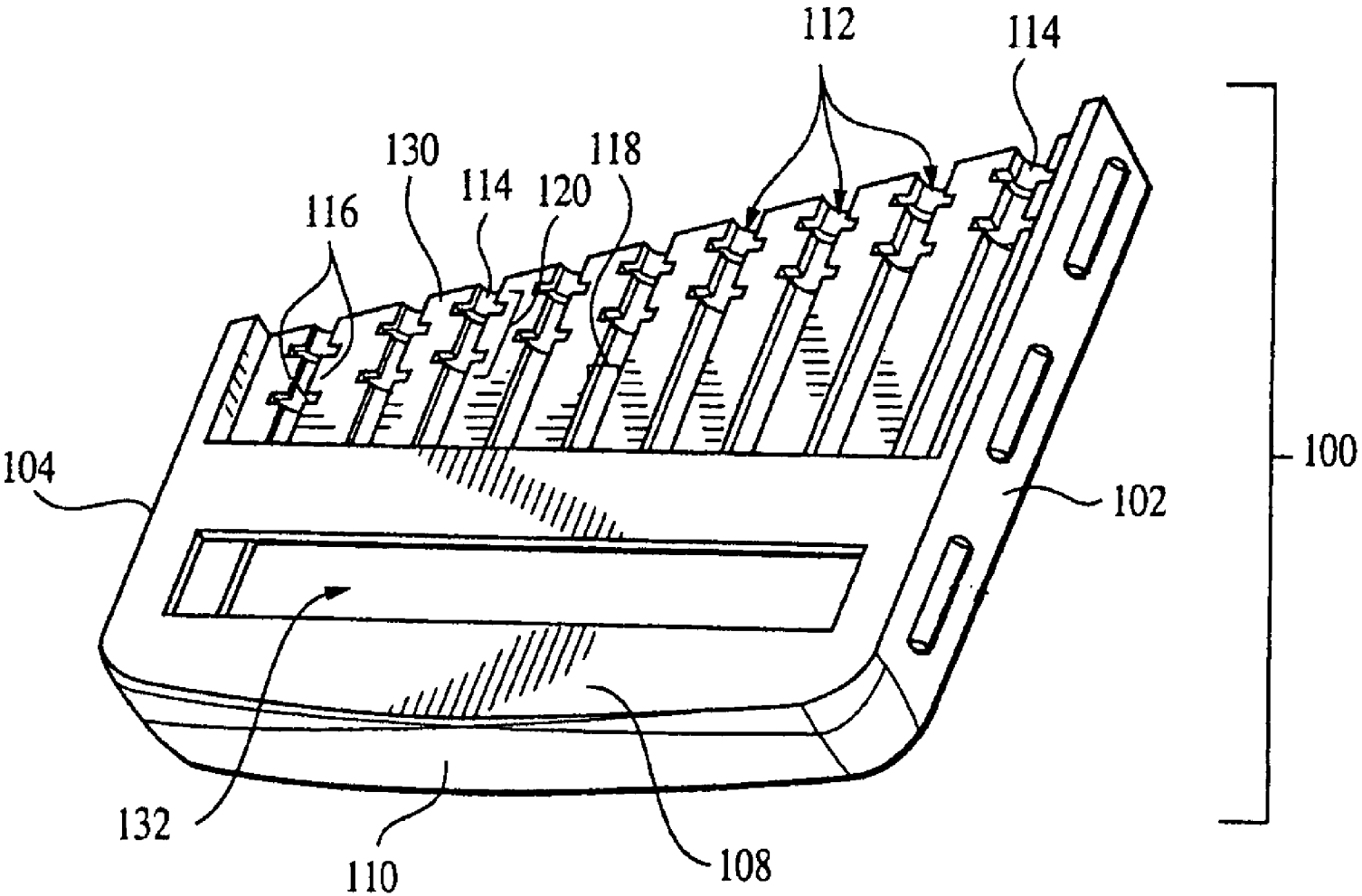
FIG. 10 is a perspective view of an embodiment of the tool tray of the present invention.
Figure 11:
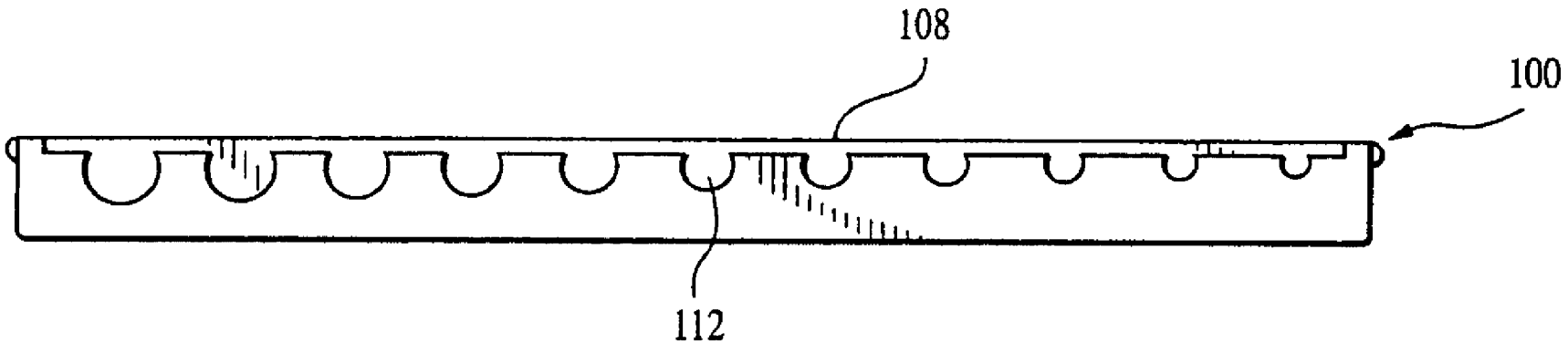
FIG. 11 is a front view of the tool tray of FIG. 10.

FIG. 10 shows one embodiment of a tool tray 100 of the present invention. The tool tray 100 desirably includes a top wall 108, two opposed side walls 102 and 104, and one rear wall 110. The opposed side walls 102 and 104 and the rear wall 110 are attached perpendicularly to the top wall 108 and extend downwardly therefrom. The tool tray 100 may be open toward the front wall 108 of the outer casing (not shown) in order to allow longer tools to be placed below the top wall 108 of the tool tray 100. The tool tray 100 may alternatively include a front wall that is integrally attached to the opposed side walls 102 and 104 and the top wall 108 (See FIGS. 11 and 17).

The top wall 108 of the tool tray 100 may vary in thickness depending upon the size of the tool part to be stored within. (See FIG. 11). Desirably, a portion of the top wall 108 will be slightly recessed to allow the tools inserted into the tool receiving recesses 112 to pass under the unrecessed portion of the top wall 108. The recessed portion of the top wall 108 will be hereinafter referred to as the tool retaining wall 130.

The unrecessed portion of the top wall 108 of the tool tray 100 may include a window 132. The window 132 is positioned at the end of the top wall 108 toward the rear wall 110. Through the window 132, the user will be able to view the tips of the drill bits that are inverted and located therein. This configuration allows the user to select a bit without taking it out of the tray 100 to determine its size.

The drill bits (best seen in FIG. 7) are removably secured to the top 108 of the tool tray 100 in equally spaced apart tool receiving recesses 112. The tool receiving recesses 112 may be partially round or may be hexagonal in cross-sectional shape. The tool receiving recesses 112 desirably have an inner surface 114 that corresponds to the shape, circumference, and length of the respective tool to be stored therein.

The tools are secured in the tool receiving recess 112 by two opposed bit retaining members 116 that extend to partially cover or partially protrude into an opening 118 at the top of the receiving recess 112. In one embodiment, the bit retaining members 116 are created by forming an H-shaped cutout 120 or molding in the top wall 108. The bit retaining members 116 are desirably directly opposed to one another or may be slightly staggered.

Figure 12:
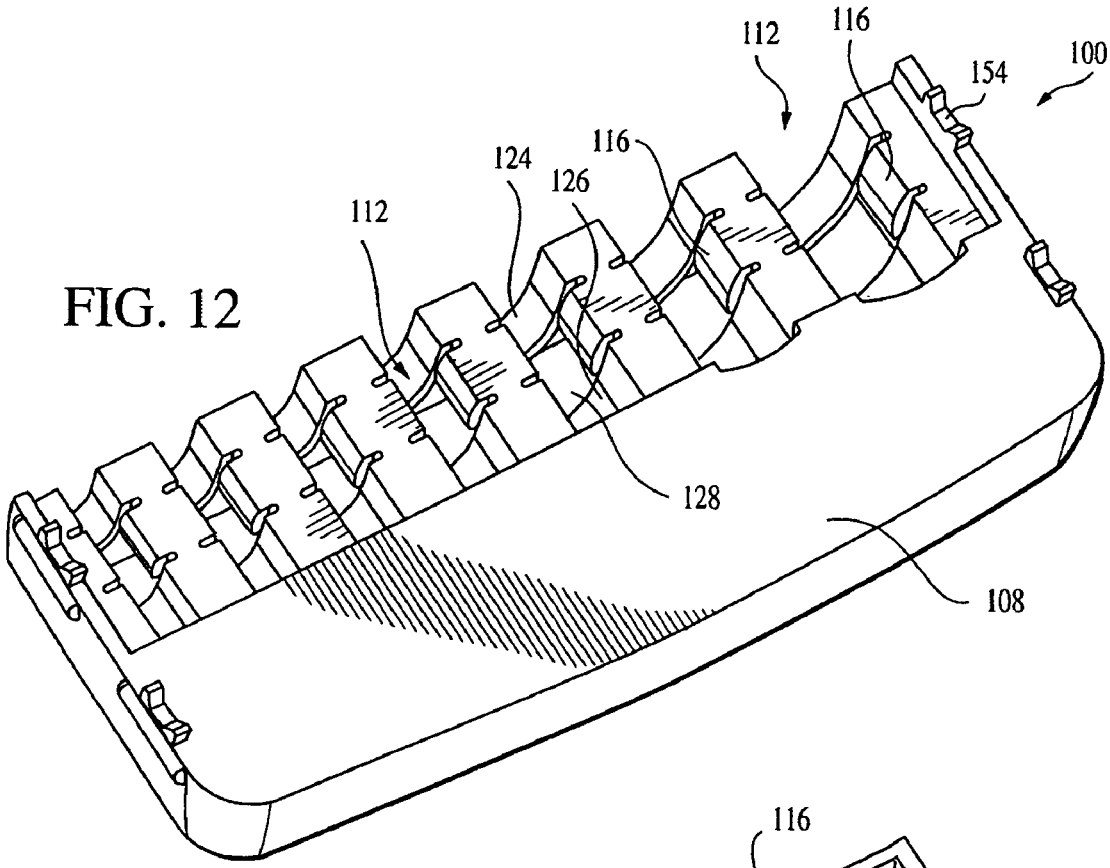
FIG. 12 is a top perspective view of another embodiment of the tool tray of the present invention.

Referring now to FIG. 12, in another embodiment of the present invention, the tool receiving recesses 112 may be defined by two opposed shelves 124 and 126 that are separated by an aperture 128. The shelves 124 and 126 may be semi-circular in shape or V-shaped. When the tool receiving recesses 112 are defined by the opposed shelves 124 and 126, the bit retaining members 116 are defined within the portion of the top wall 108 including the aperture 128. The bit retaining members 116 may be directly across from one another or may be staggered with respect to one another.

Desirably, the bit retaining members 116 may extend to partially cover the top of the tool receiving recess 112. See FIG. 10. Alternatively, the bit retaining members 116 may extend, at an angle, into the middle of the recesses 112 and hold the corresponding tool between them, rather than below them.

The tool tray 100 is made of a flexible material, such as polyurethane. The flexibility of the material enables the bit retaining members to flex locally when the drill bit is inserted, the bit retaining members 116 being selectively distorted so that the drill bits may be pushed past them by exerting pressure onto the bit. Once the drill bits are stored within the tool receiving recess 112, the durability of the material holds the drill bit between the bit retaining members 116. This flexibility also enables the male protrusions 106 and female recesses 62 to snap into place without breaking either component. See FIG. 8.

Figure 13:
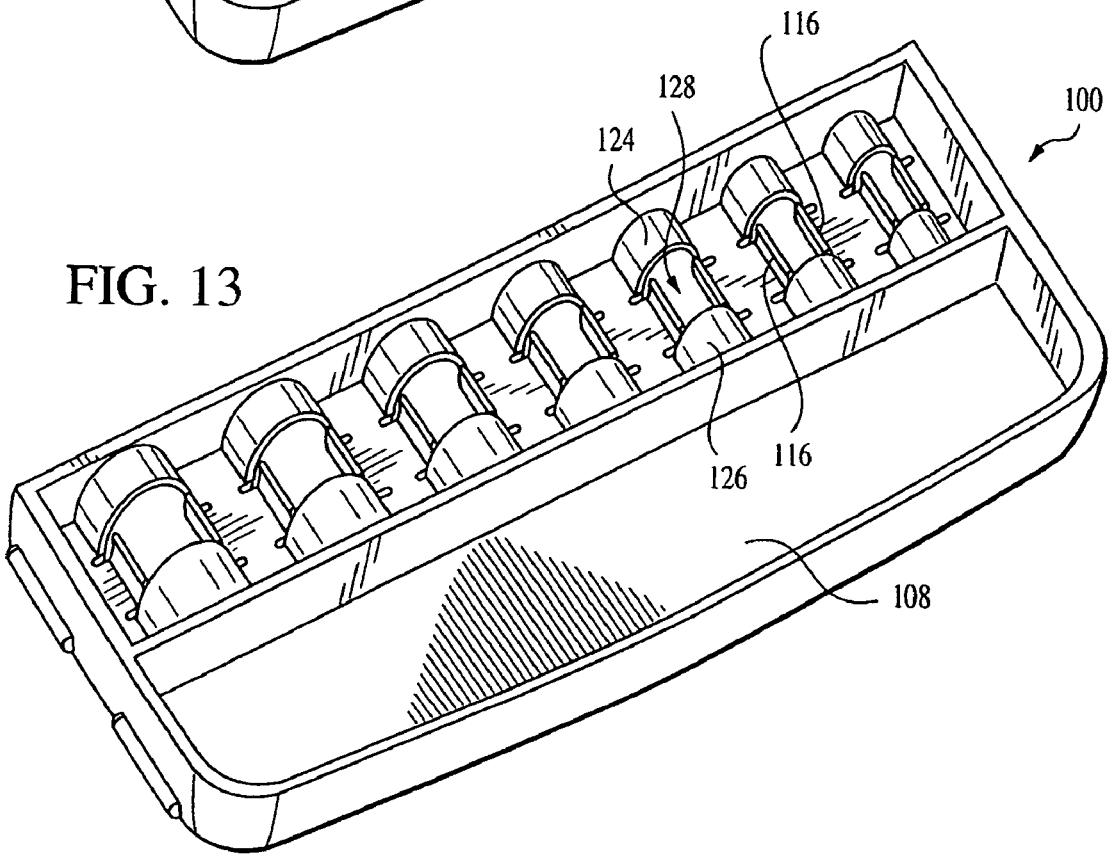
FIG. 13 is a bottom view of the embodiment of the tool tray of FIG. 12.
Figure 14:
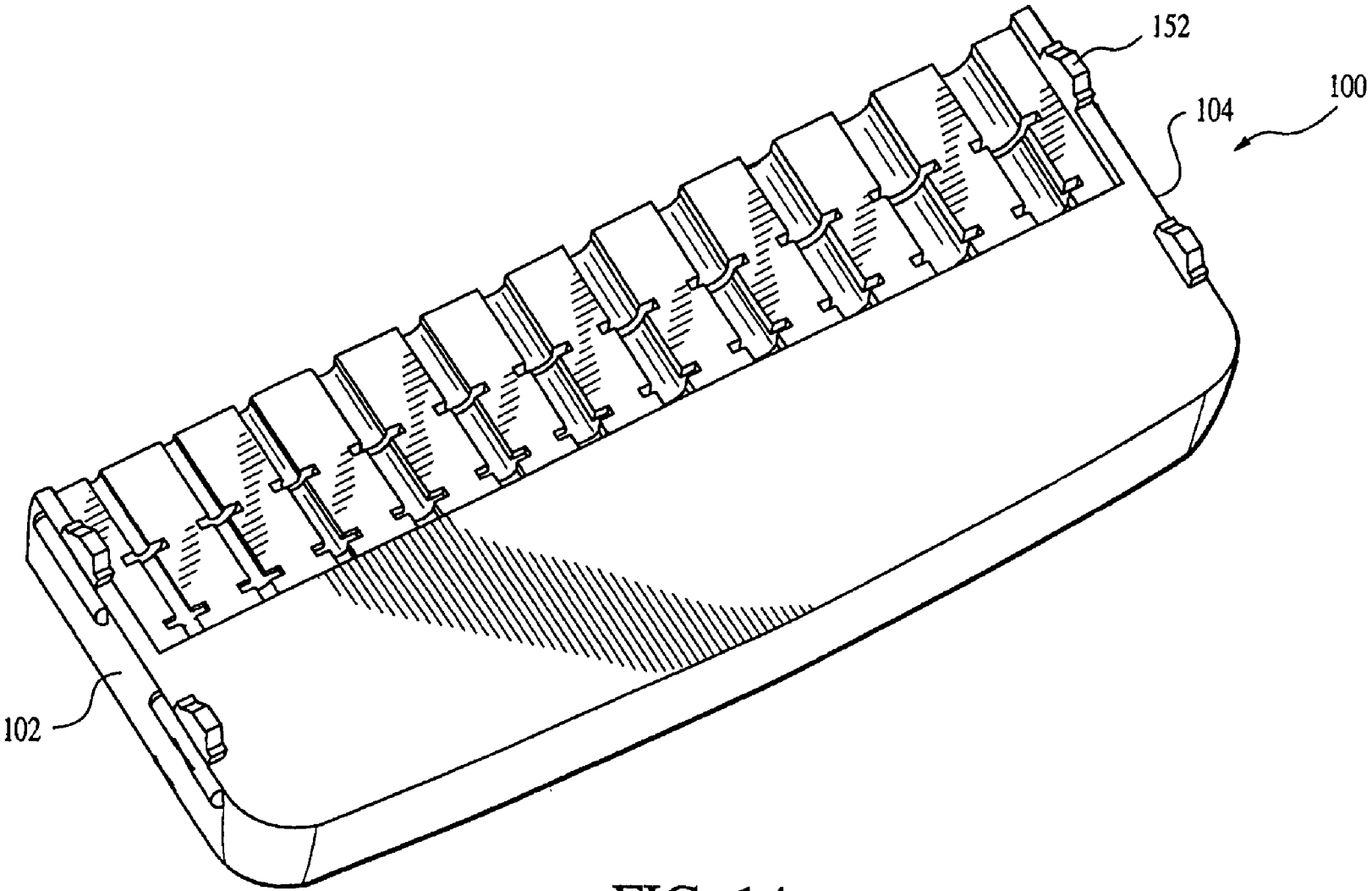
FIG. 14 is a top perspective view of another embodiment of the tool tray of the present invention.

In another embodiment of the present invention, as shown in FIGS. 12 and 14, the opposed side walls of the tool tray 100 may include interengaging upward standing tangs 152 and 154 that protrude vertically from an upper surface of each of the opposed side walls 102 and 104. Desirably, the tangs 152 located on the tool tray 100 disposed within the upper housing member will mate with the tangs 154 located on the tool tray 100 disposed within the rear housing member. This feature provides a secure fit between the tool trays 100 when the outer casing is in a closed position, ensuring that the tools are not lost while they are being transported or stored. FIG. 13 shows the underside of FIG. 12.

Figure 15:
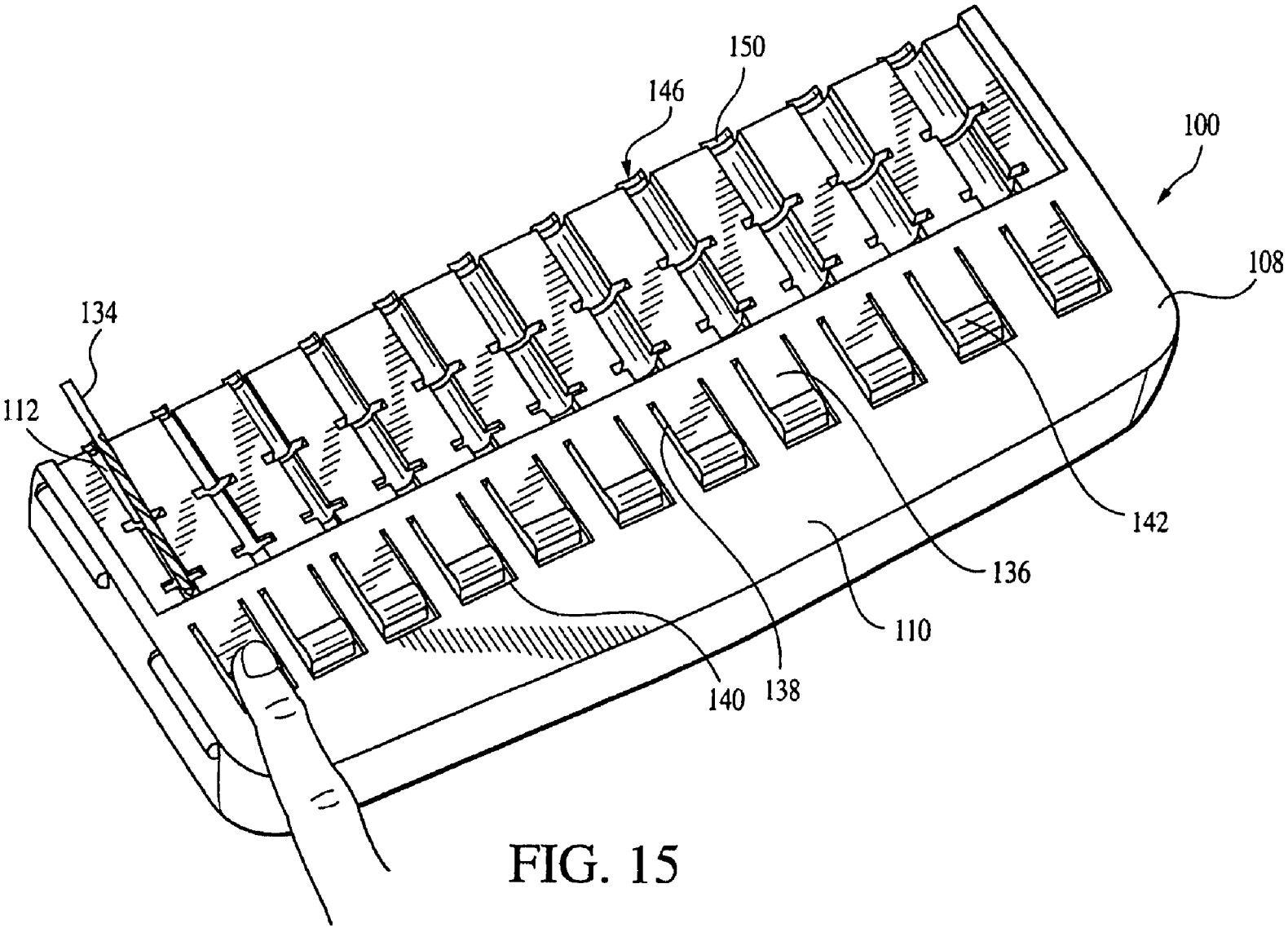
FIG. 15 is a top perspective view of another embodiment of the tool tray of the present invention.

FIG. 15 shows an embodiment of the present invention including a plurality of cantilevered releases, deformable flanges 136 to provide easy removal of the drill bits 134 from the tool receiving recesses 112. The levers 136 are created by U-shaped cutouts 138 that are defined through the top wall 108 of the tool tray 100. The bottoms 140 of the U-shaped cutouts 138 face the rear wall 110. The levers 136 are disposed along the top wall 108 in positions that align with the positions of the drill bits 134 in a full tool receiving recess 112. The levers 136 may further include bumps, or pushbuttons 142, on the top surface of the lever 136. The pushbuttons 142 allow the user to contact and depress the lever 136.

Figure 16:
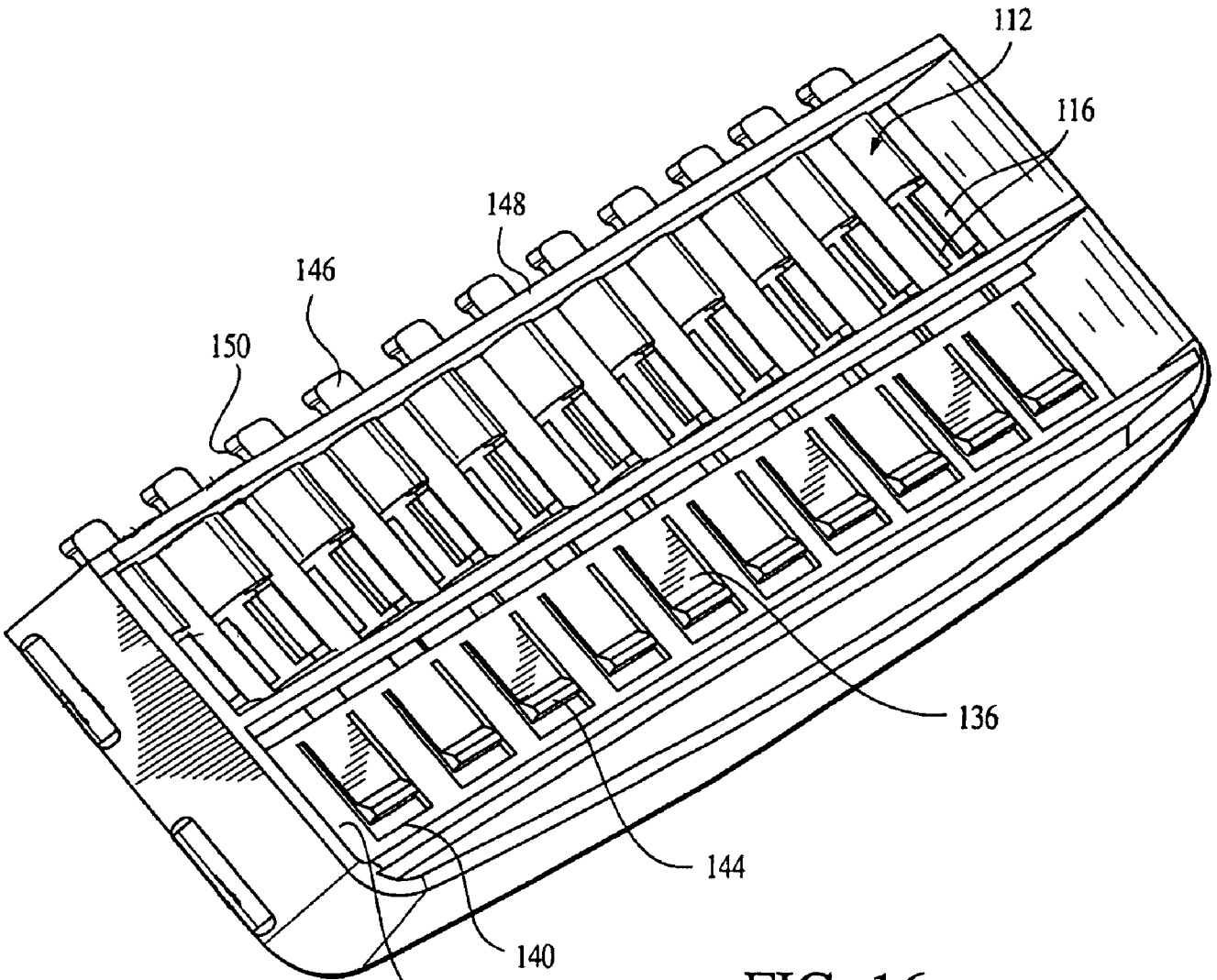
FIG. 16 is a bottom perspective view of the tool tray of FIG. 12.

FIG. 16 shows the underside of the cantilevered tray. The underside of the cantilevered releases 136 includes a plurality of tangs 144 that protrude in a downward direction from the underside of the lever 136. The tangs 144 contact the drill bit that has been inserted in to the tool receiving recess 112. The tangs 144 give the levers 136 added lateral extension to increase the full extent of the depressed lever 136.

When appropriate downward pressure is applied to the pushbuttons 142 (as shown in FIG. 15), the levers 136 on the top wall 108 will flex downward and, through the tangs 144, exert pressure onto the end of the drill bit below. The end of the drill bit is positioned below the lever 136. When the tangs 144 exert their downward pressure on the drill bit, slight upward pressure is applied to the bit retaining members 116 on the tool receiving recess 112 by the bit itself exerting a cantilevered action. The bit retaining members 116 flex, and then deform, to allow the bit to move upward and past the members 116, thereby releasing the bit from the tool receiving recess 112. This movement makes the elevated portion of the bit easy for the user to grasp and remove.

As shown in FIGS. 15 and 16, the tool tray 100 may include support extensions 146 extending outwardly from a front wall 148 of the tool tray 100 in an L-shaped manner. These extensions 146 are particularly useful when the tool receiving recesses 112 and the tools stored therein are hexagonal in shape. The extensions 146 are generally disposed in about the center of the front of the tool receiving recess 112 and include upper surfaces 150. The shape of the upper surface will desirably correspond to the shape of the tool to be stored in the recess. Desirably, the upper surfaces are V-shaped or semi-circular to support the shape of the tools placed within the recesses. In order to more easily facilitate removal of the tool from the recess, the tool may be pressed, in a downward manner, against the extension 146. This feature provides the craftsman more leverage for removing the tool.

Figure 17:
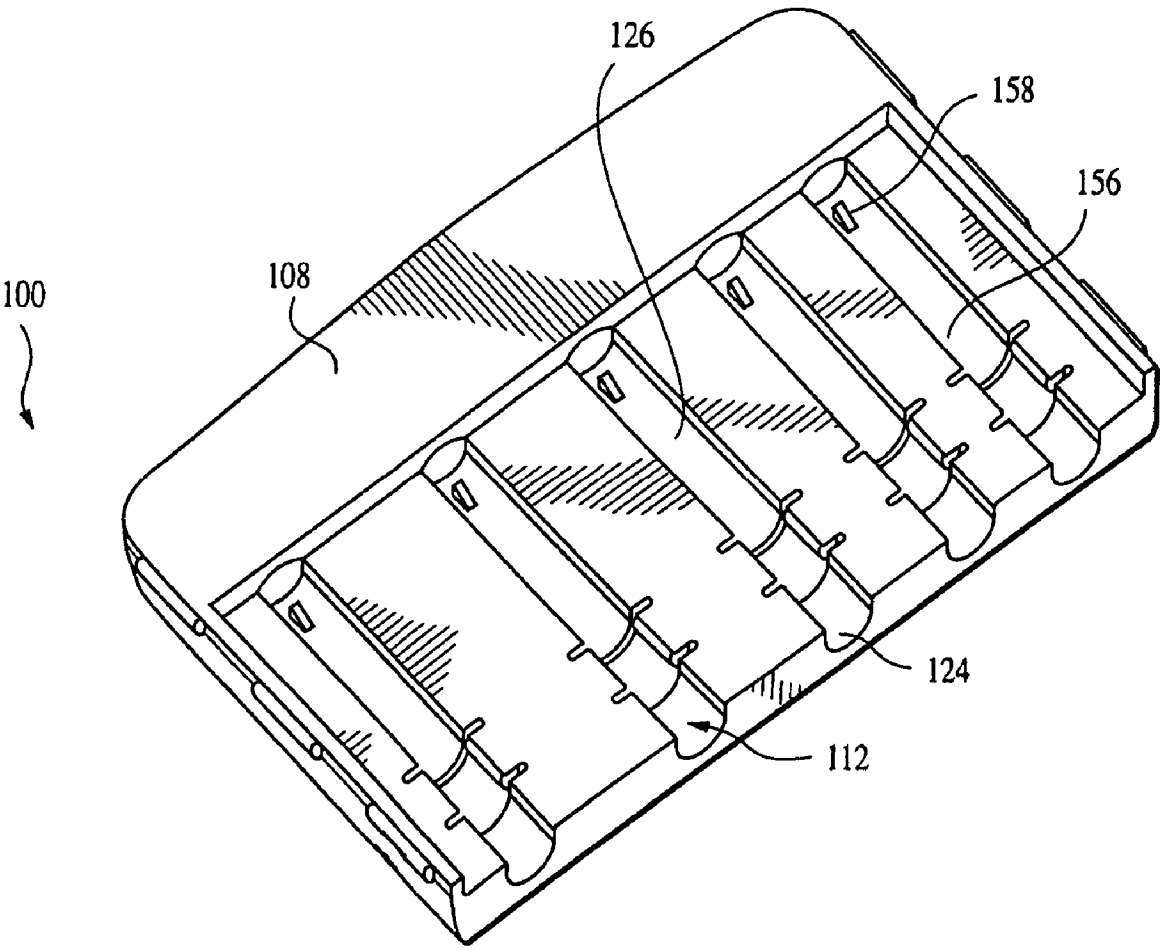
FIG. 17 is a top perspective view of another embodiment of the tool tray of the present invention.

FIG. 17 shows yet another embodiment of the present invention. The inner surface 156 of the tool receiving recesses 112, or one of the opposed shelves 124 and 126, may include vertically protruding nodules, or nibs 158, that extend from the inner surface 156 of the tool receiving recess 112 in the general direction of the top wall 108 of the tool tray 100. The nibs 158 are desirably located toward the rear of the recesses 112, toward the rear wall 110 of the tool tray 100.

It is intended that the foregoing detailed description be regarded as illustrative rather than limiting, and numerous variations may be made to the embodiments disclosed herein without departing from the scope of this invention.

While preferred embodiments of the invention have been described, it should be understood that the invention is not so limited and modifications may be made without departing from the invention. For example, the male protrusions may be molded to project outwardly from the interior surface of opposed side walls of the outer casing and the corresponding female recesses molded into the tool tray. Also, additional tool mounts may be added to the outer casing to define pockets behind the tool tray. Additional side walls may extend downwardly from the casing-facing surface of the top of the tool tray. These additional walls define cavities to further separate tools for organization and storage.

The invention claimed is:

1. A tool retaining system comprising:

an outer casing having at least one housing member with upstanding walls extending approximately perpendicularly from a base and a plurality of female recesses defined within said walls;

a tool tray having at least two opposed side walls extending approximately perpendicularly downward from a top wall, the opposed side walls having an outer surface, the outer surface having one or more male protrusions extending therefrom, and the top wall having a plurality of tool receiving recesses, each of the tool receiving recesses including at least two opposed bit retaining members; and wherein the male protrusions on the tool tray snap into the female recesses on the walls of the outer casing to retain the tool tray in the casing such that the tool tray cannot slide relative to the casing, said male protrusions being removable from the female receptacles by a user such that the tool tray can be removed from and reinserted into the outer casing.

2. The tool retaining system of claim 1, wherein the outer casing and the at least one tool tray are comprised of a flexible material.

3. The tool retaining system of claim 1, wherein the tool receiving recesses are defined in a semi-circular cross-sectional shape comprising two semi-circular shelves disposed within the tool receiving recesses where the opposed bit retaining members are disposed between the shelves.

4. The tool retaining system of claim 1, wherein the bit retaining members are formed to protrude at least partially into the tool receiving recesses.

5. The tool retaining system of claim 1, wherein the tool receiving recesses are defined by an inner surface having a length that is hexagonal in cross-sectional shape, and two semi-hexagonal recesses perpendicularly disposed within the tool receiving recesses defining the opposed bit retaining members.

6. The tool retaining system of claim 1, wherein the top wall of the tool tray has a recessed portion and a non recessed portion, the non recessed portion including cantilevered release members.

7. The tool retaining system of claim 6, wherein the cantilevered release members are disposed overlappingly to the tool receiving recesses, and wherein the cantilevered release members have tangs extending downwardly therefrom.

8. The tool retaining system of claim 1, wherein the tool receiving recesses has a raised nib for engaging an elongated tool.

9. A tool retaining system comprising:

at least two housing members that are hingedly attached with respect to one another, at least one of the housing members defining a recessed cavity for receiving a tool tray, the cavity comprised of a base and at least two upstanding walls;

a tool tray secured to the at least one housing member; and an elastomeric band disposed at least partially about the periphery of at least one of the at least two housing members and attached to the at least one of the at least two housing members, said elastomeric band comprised of a first material and the at least one of the at least two housing members comprised of a second material.

10. The tool retaining system of claim 9, wherein the first material and the second material are comprised of a flexible material.

11. The tool retaining system of claim 9, wherein the housing members have a split-rail latch, split-rail having opposed abutments preventing the latch from sliding to either end of the split-rail.

12. The tool retaining system of claim 9, wherein the housing members have a split-rail latch, the latch includes at least one abutment preventing the latch from sliding to the end of the split-rail.

13. The tool retaining box of claim 9, wherein each housing member is defined by a first pair of opposed side walls and a second pair of opposed side walls upstanding from a base, and wherein the elastomeric band surrounds the first pair of opposed side walls and defines a flat thread pattern therein.

14. The tool retaining box of claim 13, wherein two of the opposed side walls include feet that support the tool retaining box.

15. The tool retaining box of claim 9, wherein the elastomeric band is comprised of rubber.

16. The tool retaining box of claim 9, wherein the elastomeric band includes at least one flat surface disposed about at least one of a first opposing side wall enabling the tool retaining system to stand on the side wall.

17. The tool retaining system of claim 9, wherein the housing members are comprised of plastic.

18. A tool retaining system comprising an outer casing and an inner tool tray, the outer casing comprising two bingedly attached housing members that open and close along a hinge between an open position and a fully closed position, each of the housing members being defined by a base and a plurality of upstanding walls, and the outer casing being secured by a split rail latch wherein at least one housing member includes at least one abutment preventing the latch from sliding to an end of the split-rail when the housing members are in the fully closed position.

19. The tool retaining system of claim 9 wherein said first material is softer than said second material.

20. The tool retaining system of claim 9 wherein the elastomeric band is disposed at least partially about the periphery of said at least two housing members.

21. The tool retaining system of claim 20 wherein the elastomeric band defines a flat tread pattern protruding from the periphery of said at least two housing members.

22. The tool retaining system of claim 9 wherein the elastomeric band is disposed about the entire periphery of at least one of the at least two housing members.

* * * * *

UNITED STATES PATENT AND TRADEMARK OFFICE

CERTIFICATE OF CORRECTION

PATENT NO. : 7,225,923 B2
APPLICATION NO. : 10/722906
DATED : June 5, 2007
INVENTOR(S) : Hallee et al.

It is certified that error appears in the above-identified patent and that said Letters Patent is hereby corrected as shown below:

Column 10, Claim 18, line 11 change “bingedly” to --hingedly--

Signed and Sealed this

Sixteenth Day of October, 2007

JON W. DUDAS
*Director of the United States Patent and Trademark Office*